United States Patent [19]

Stine et al.

[11] 4,041,237

[45] Aug. 9, 1977

[54] ELECTRIC CONDUCTOR ADAPTED FOR USE IN PROCESS INSTRUMENTATION

[75] Inventors: Clifford R. Stine, Solon; Bruce E. Klipec, Aurora; William J. Herbert, Mantua, all of Ohio

[73] Assignee: Samuel Moore & Company, Aurora, Ohio

[21] Appl. No.: 656,722

[22] Filed: Feb. 9, 1976

Related U.S. Application Data

[63] Continuation of Ser. No. 498,716. Aug. 19, 1974, abandoned.

[51] Int. Cl.[2] ..... H01B 3/30; H01B 7/18

[52] U.S. Cl. ..... 174/36; 174/110 FC; 174/110 PM; 174/115; 264/22; 427/35

[58] Field of Search ..... 174/110 PM, 110 AR, 174/110 SR, 110 R, 115, 113 R, 107; 264/22; 427/12, 35, 36

[56] References Cited

U.S. PATENT DOCUMENTS

| | | | |
|---|---|---|---|
| 3,032,604 | 5/1962 | Timmons | 174/15 |
| 3,725,230 | 4/1973 | Bahder et al. | 174/110 PM X |
| 3,852,518 | 12/1974 | Wargotz et al. | 174/110 PM X |

*Primary Examiner*—Arthur T. Grimley
*Attorney, Agent, or Firm*—Stevens, Davis, Miller & Mosher

[57] ABSTRACT

An electrically insulated conductor adapted to be used at high temperatures in power plants, refineries and chemical process plants for connecting instruments has at least one pair of electrical conductors insulated with an irradiation cured ethylene-tetrafluoroethylene copolymer, ethylene-chlorotrifluoroethylene copolymer or polyvinyl chloride polymer and a drain wire enclosed in a metallic shield and an irradiation cured halosulfonated polyethylene, polychloroprene or chlorinated polyethylene jacket.

13 Claims, 2 Drawing Figures

ELECTRIC CONDUCTOR ADAPTED FOR USE IN PROCESS INSTRUMENTATION

This is a continuation of application Ser. No. 498,716 filed 8/19/74.

This invention relates generally to electrical conductors and more particularly to an insulated wire having improved properties at elevated temperatures.

Electric wires having a synthetic resinous insulation are used extensively in power plants, refineries and chemical plants for connecting instruments used in process control. For example, wires of this type are used to connect a potentiometer or the like to a remote thermocouple. Such a wire may also be used for electrically connecting a transmitter or differential cell with a process control room. The heretofore available insulated wires have not been entirely satisfactory because they are not dimensionally stable in the sense that the insulation tends to melt and flow off the wire at elevated temperatures.

It is therefore an object of this invention to provide an improved electrically insulated wire for use in instrumentation in chemical process plants, power plants, nuclear generating plants and the like. Another object of the invention is to provide an insulated conductor having dimensional stability and improved resistance to stress cracking which adapt it for use at elevated temperatures of 400° F. or higher. Still another object of the invention is to provide a method for making an electrical conductor adapted for use as the connecting link in instrumentation in power plants, chemical process plants and the like.

Other objects will become apparent from the following description with reference to the accompanying drawing wherein.

Figures 1, 2:
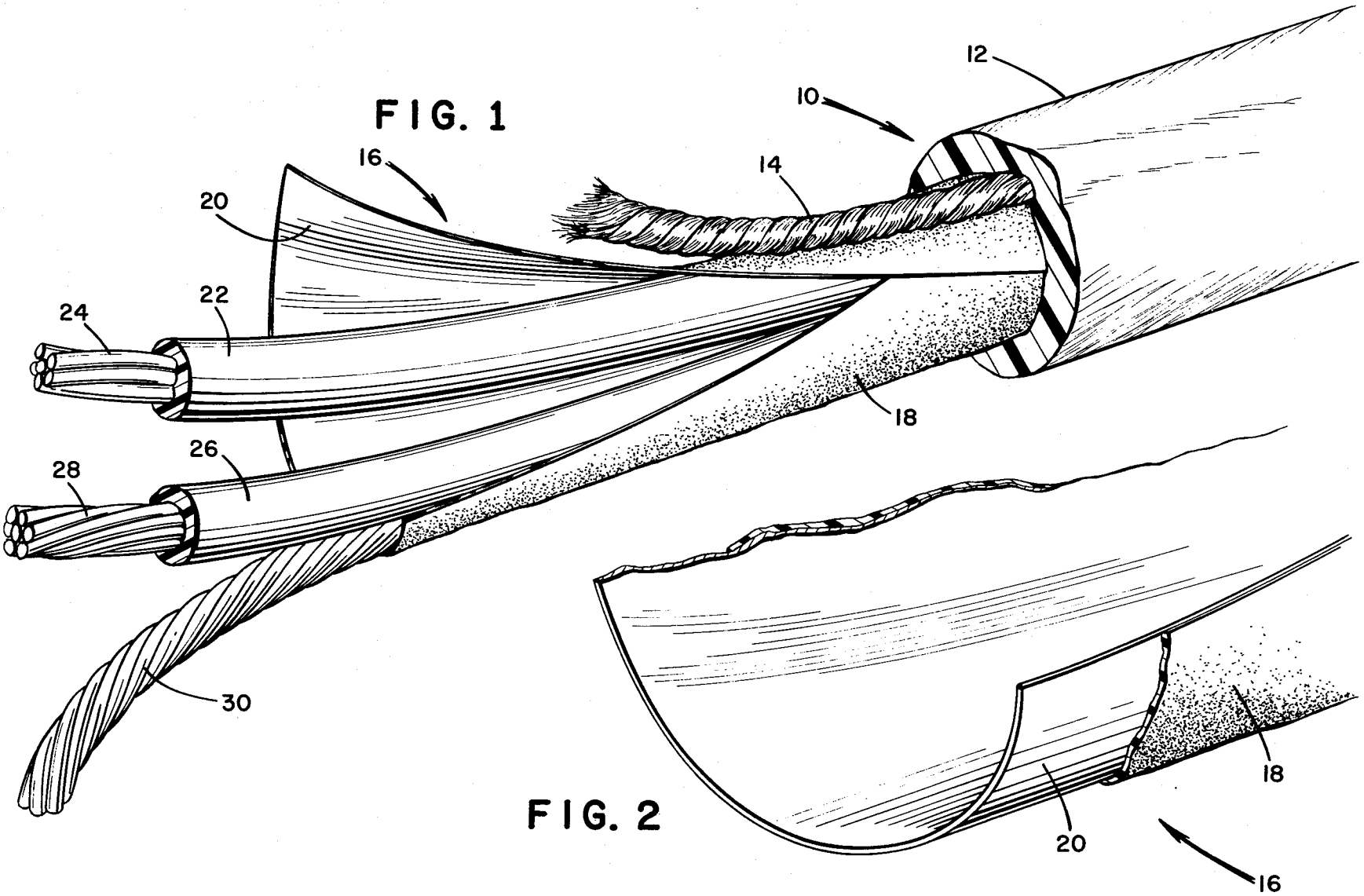
FIG. 1 is a perspective view of an embodiment of the invention.
FIG. 2 is an enlarged fragmentary perspective view of a metallic shield used in the embodiment of FIG. 1.

The foregoing objects and others are accomplished in accordance with this invention, generally speaking, by providing an electrical conductor having at least one pair of electrical conducting wires which are electrically insulated with an irradiation cured ethylene-tetrafluoroethylene copolymer, ethylene-chlorotrifluoroethylene copolymer, or polyvinyl chloride polymer or copolymer coating and a jacket of an irradiation cured halosulfonated polyethylene, polychloroprene, or chlorinated polyethylene. Preferably, an electrically conducting shield is disposed about the electrical conductors. An uninsulated drain wire may be disposed on either side of the shield in electrical contact therewith. A rip-cord may be disposed between the jacket and shield for facilitating the stripping of the jacket from about the electrical conductors. The electrical conductor provided by the invention may be made by a process wherein an electrical insulating coating of a composition containing ethylene-tetrafluoroethylene copolymer, ethylene-chlorotrifluoroethylene, or polyvinyl chloride polymer is extruded on a suitable wire, the resulting electrical insulated wire is associated with a ground wire and a metallic foil is folded about or helically wrapped about the wires, a composition containing a halosulfonated polyethylene, polychloroprene or chlorinated polyethylene is extruded over the wrapped wires and the resulting electrical conductor is cured by subjecting it to a source of high energy electrons.

Any suitable source of high energy electrons may be used for curing the polymer composition such as, for example, a Van de Graff accelerator or the like. Preferably, the energy of the electrons should be from about 100,000 electron volts to 3 mev. (million electon volts). The electrical conductor may be wound on a suitable spool or the like after the jacket has been extruded thereon for storage and may be later unwound and passed through a source of electrons when it is desired to cure the jacekt and insulation. It has been found that the jacket and the insulation on a pair of wires can be cured simultaneously in one pass through the electron source but it is preferred to irradiate the insulation on the wires before the wires are enclosed in the jacket. A dosage of electrons should be from about 2 Mrads (megarads) to about 20 Mrads, preferably, from about 5 Mrads to about 12 Mrads. Curing may be at ambient temperature and atmospheric pressure. The wire may be passed through the electron source at any suitable speed with linear speeds of 500 ft. per minute usually providing a dosage sufficient to cure the polymers and improve the heat resistance properties of the insulated conductor.

One suitable ethylene-tetrafluoroethylene copolymer is sold by E.I. duPont de Nemours and Co. under the trade name "TEFZEL" and is described in U.S. Pat. No. 3,738,923. "HALAR" is the trade name for a suitable ethylene-chlorotrifluoroethylene copolymer sold by Allied Chemical Co. Ethylene-chlorotrifluoroethylene copolymers are also disclosed in U.S. Pat. No. 5,738,923.

The electrically conductive shield protects the conductors from electrostatic noise which would interfere with the performance of instruments connected by the conductors. The shield may be copper, aluminum or other metal foil or other electrically conductive layer such as electrically conductive polyethylene which is flexible. A metal foil coated with Mylar is preferred.

Referring now to the drawing, the illustrated embodiment of a cable 10 has a pair of electrically insulated conductors 24 and 28 of wires each having an electrical insulating coating 22 and 26, respectively, about 10 mils thick of an irradiation cured ethylene-tetrafluoroethylene copolymer, twisted with a tinned copper drain wire 30, a shield 16 having a flexible aluminum foil layer 20, a poly(ethylene terephthalate) ester coating 18 helically wound at a lay of about two inches about the wires 24, 28 and 30, a nylon 6 rip-cord 14 and a jacket 12 of an extruded chlorosulfonated polyethylene polymer sold by E.I. duPont de Nemours and Co. under the trade name "HYPALON". The shield 16 may be an aluminum foil about 0.1 to 2 mils thick having a coating of "Mylar" about 0.5 mil to about 5 mils thick adhered thereto. MYLAR is a poly(ethylene-terephthalate)ester sold by E.I. duPont de Nemours and Co.

Cable 10 is fabricated by extruding an unfilled ethylene-tetrafluoroethylene copolymer containing about 50 mol percent ethylene and about 50 mol percent tetrafluoroethylene mixed with about 3 parts triallylisocyanurate sensitizer per 100 parts polymer as a coating about 10 mils thick over twisted wires 24 and 28. The resulting electrically insulated conductors 24 and 28 are then twisted with a tinned copper drain wire 30 at a lay of about 2 inches and the shield 16 is helically wrapped thereabout. The resulting jacketed wire assembly is then enclosed in jacket 12 by extruding a coating about 20 – 80 mils thick thereover. The cable 10 is then passed through an electron accelerator at a rate which provides a dosage of 2 - 20 Mrads. to cure coatings 22, 26 and jacket 12.

The jacket 12 may be formed by extruding a mixture containing in parts by weight 100 parts Hypalon 45
30 parts litharge
60 parts hydrated alumina
10 parts antimony trioxide
5 parts chlorinated paraffin wax
3 parts petrolatum
2 parts paraffin wax
2 parts HVA-2 m-phenylene dimaleimide (sensitizer)
15 parts carbon black Any other suitable compounds which sensitize a polymer to irradiation curing may be used in either the polymer of the jacket 12 or the polymer used for insulation 22 and 26. A triallyisocyanurate sensitizer or the like may be used with the ethylene-chlorotrifluoroethylene copolymer, polyvinyl dichloride polymer as well as with ethylene-tetrafluoroethylene. It is preferred to include a sensitizer in the composition to accelerate curing but suitable curing can be obtained with increased exposure time without the sensitizer.

Any suitable filler such as, for example, litharge, Kaolin, calcinated clay, carbon black, zinc oxide, talc, hydrous magnesium silicate, lead oxide, hydrated aluminum silicate or the like may be used in the polymer composition from which jacket 12 is extruded. The amount of filler should be sufficient to provide an extruded thermoplastic composition which can be handled without substantial distortion before curing. Preferably, the uncured jacket should have a hardness of at least Shore 45A and a minimum tensile modulus or tensile strength at 100% elongation of at least about 300 p.s.i. After curing, the jacket should have a hardness of at least about Shore 50A and a tensile strength at 100% elongation of about 400 p.s.i. Usually, from about 50 to 250 parts filler per 100 parts by weight polymer will provide a composition of sufficient hardness to facilitate extrusion of the jacket.

The composition from which the jacket is extruded may also contain a plasticizer such as a vinyl silane, paraffin oil or the like. An antioxidant may also be included such as, for example, poly(trimethyl-dihydroquinoline).

Conventional extrusion equipment may be used to form the insulation on the wires and to shape the jacket.

Conductors having wires insulated with an ethylene-chlorotrifluoroethylene copolymer or polyvinyl dichloride polymer and having a jacket shaped from compositions containing a polychloroprene or a chlorinated polyethylene can be substituted for the one described in detail in the foregoing description with reference to the drawing.

Although the invention is described in detail for the purpose of illustration it is to be understood that such detail is solely for that purpose and that variations can be made therein by those skilled in the art without departing from the spirit and scope of the invention except as it may be limited by the claims.

What is claimed is:

1. An electrical cable having improved dimensional stability and other properties which adapt it for use at elevated temperatures comprising at least two electrical conductors each having (1) an electrical insulating coating, said coating being an irradiation cured member selected from the group consisting of ethylene-tetrafluoroethylene copolymer, ethylene-chlorotrifluoroethylene copolymer and polyvinyl chloride, and (2) a protective jacket selected from the group consisting of irradiation cured halosulfonated polyethylene polymer, a polychloroprene and chlorinated polyethylene about the insulated conductors.

2. The product of claim 1 having a drain wire and an electrically conductive shield separating the insulated conductors and drain wire from the protective jacket.

3. The product of claim 2 wherein the said electrical insulating coating is an ethylene-tetrafluoroethylene copolymer and the jacket is chlorosulfonated polyethylene.

4. The product of claim 2 wherein the said electrical insulating coating is an ethylene-chlorotrifluoroethylene copolymer.

5. The product of claim 2 having a rip-cord disposed between the shield and the jacket.

6. A method of making an electrical cable having improved dimensional stability comprising providing at least two electrical conductors each having an electrical insulating coating, said coating being a member selected from the group consisting of an ethylene-tetrafluoroethylene copolymer, ethylene-chlorotrifluoroethylene copolymer and polyvinyl chloride, extruding a jacket selected from the group consisting of a chlorosulfonated polyethylene polymer, polychloroprene and chlorinated polyethylene over the insulated conductors, and subjecting the resulting product to irradiation until the polymer of the said jacket is cross-linked.

7. The method of claim 6 wherein the insulated conductors and a drain wire are twisted together, an electrically conductive shield is placed about the insulated conductors and a jacket is extruded over the shield.

8. The method of claim 6 wherein an electrically conductive shield is placed about the insulated conductors, a drain wire is placed in electrical contact with the shield and a jacket is extruded over the resulting assembly.

9. The method of claim 7 wherein the shield is a foil having a coating of a poly(alkylene)terephthalate ester and the drain wire is in electrical contact with the foil.

10. The product of claim 2 wherein the metallic shield has a poly(alkylene)terephthalate coating adjacent the jacket.

11. The method of claim 6 wherein the insulation on the conductors is ethylene-tetrafluoroethylene polymer and the jacket is chlorosulfonated polyethylene polymer.

12. The method of claim 6 wherein the uncured jacket is exposed to a dosage of from about 2 to about 20 Mrads.

13. An electrical cable adapted to be used at elevated temperatures comprising electrical conductors each electrically insulated with an insulating coating comprising an irradiation cured resin selected from the group consisting of ethylene-tetrafluoroethylene copolymer, ethylene-chlorotrifluoroethylene co-polymer and polyvinyl chloride enclosed in a layer of irradiation cured synthetic resin selected from the group consisting of halosulfonated polyethylene polymer, a polychloroprene and a chlorinated polyethylene, said electrical conductors being twisted together to form a cable.

* * * * *